United States Patent [19]

Kobelt

[11] Patent Number: 4,702,082

[45] Date of Patent: Oct. 27, 1987

[54] LOAD SHARING APPARATUS AND METHOD FOR MULTIPLE ENGINES

[76] Inventor: Jacob Kobelt, 6110 Oak Street, Vancouver, British Columbia, Canada, V6M 2W2

[21] Appl. No.: 745,131

[22] Filed: Jun. 17, 1985

[51] Int. Cl.[4] ..... F02D 25/00

[52] U.S. Cl. ..... 60/710; 60/711; 60/716

[58] Field of Search ..... 60/710, 711, 716, 420; 123/383

[56] References Cited

U.S. PATENT DOCUMENTS

| | | | |
|---|---|---|---|
| 2,817,211 | 12/1957 | Reiners | 60/710 |
| 2,916,885 | 12/1959 | Smith | 60/710 |
| 3,234,740 | 2/1966 | Moore | 60/710 |
| 4,258,552 | 3/1981 | Ryker et al. | 60/710 X |
| 4,277,945 | 7/1981 | Esthimer et al. | 60/710 |

FOREIGN PATENT DOCUMENTS

| | | | |
|---|---|---|---|
| 7748 | 1/1984 | Japan | 60/711 |

*Primary Examiner*—Edward N. Look
*Attorney, Agent, or Firm*—Carver & Co.

[57] ABSTRACT

A load sharing apparatus and method for coupled master and slave engines having respective throttle actuators to receive initial throttle signals, and load transmitters for transmitting load signals reflecting load on the particular engine. Apparatus has a load comparison structure which receives load signals from the load transmitters of the engines and produces a differential signal reflecting comparison of the engine loads. The apparatus also includes a servo structure which receives the differential signal and produces an output signal which is a servo signal. The servo signal is transferred to the throttle actuator of the slave engine, to change the initial throttle signal to the slave engine by an amount dependent on the servo signal thus sharing loads equally between the master and slave engines.

24 Claims, 6 Drawing Figures

LOAD SHARING APPARATUS AND METHOD FOR MULTIPLE ENGINES

BACKGROUND OF THE INVENTION

1. Field of the Invention

The invention relates to a load sharing apparatus for coupled master and slave engines, in particular for at least two prime movers directly coupled through a gearbox of a marine vessel, or for vehicle-mounted prime movers connected in tandem.

2. Prior Art

It is well known to increase power input into an apparatus, such as a gearbox, by coupling two or more engines together. Also it is known to couple together several self-propelled vehicles such as locomotives, to increase pulling power for a train. Usually there is little tolerance to differences in power output between the engines, and consequently it is important that the load is shared as equally as possible between the engines. Prior art load sharing devices utilize electronic speed matching devices, which usually utilize a feedback loop when an error signal is generated and adjustments are made until the error signal becomes zero. Such electronic devices tend to be complex, and require servicing by skilled electronic personnel. Alternatively, pneumatic devices have been utilized, but, to the inventor's knowledge, such devices have suffered from the lack of accuracy that is commonly found in pneumatic circuits, and also such devices are prone to "hunting" with a corresponding fluctuating load on the engines.

SUMMARY OF THE INVENTION

The invention reduces the disadvantages and difficulties of the prior art by providing a fluid actuated circuit, in which the primary fluid is hydraulic fluid, and the hunting tendency found in the prior art pneumatic circuits is reduced, or eliminated completely. Furthermore, the invention is characterized by relatively simple hydraulic circuits and components, which permit servicing by personnel familiar with hydraulics who are also usually familiar with heavy duty power units. Also the hydraulic servicing does not require the same level of skill as that associated with complex electronics.

A load sharing apparatus according to the invention is for sharing loads between coupled master and slave engines. Each engine has a throttle acutator for receiving an initial throttle signal from a control head, and for controlling speed means of a particular engine. Each engine also has an engine load transmitter for transmitting a load signal which reflects load condition of the particular engine. The load sharing apparatus includes a load comparison means, a servo means, and a coupling means. The load comparison means has a comparison input means to receive the load signals from each engine, and has a comparison output means to produce a differential signal reflecting comparison of the engine load signals. The servo means has a servo control input adapted to receive the differential signal from the comparison means, and a servo output means producing a servo signal in response to the differential signal. The coupling means couples the servo output means to the throttle actuator of the slave engine to change the initial throttle signal to the slave engine by an amount dependent on the servo signal to form a resultant throttle signal to the slave engine.

In one embodiment the differential signal is a pressurized control fluid signal, and the servo means permits the differential signal to act against a constant force. In another embodiment, the comparison input means are sensor elements and the load signals from each engine are translated into movement of a respective sensor element. Also, the load comparison means includes force combining means adapted to cooperate with the sensor elements such that forces from the sensor elements act in opposition on the force combining means to produce the differential signal which is responsive to difference in operating loads of the engine.

A method according to the invention is for sharing loads between coupled master and slave engines having respective throttle actuators to receive initial throttle signals, and load transmitters for transmitting load signals for reflecting load on the particular engine. The method includes steps of: comparing load signals from each engine and producing a differential signal to reflect the comparison of said load signals; permitting the differential signal to act against a constant force to produce as a servo output a servo signal in response to the differential signal; and changing the initial throttle signal to the slave engine by an amount dependent on the servo signal to form a resultant throttle signal to the slave engine. In the method, the differential signal represents a degree of inequality between the power outputs of the master and slave engines. If required, a negative feedback signal can be combined with the two engine load signals to produce the differential signal in such a manner that over-shoot or under-shoot tendencies are reduced.

A detailed disclosure following describes a preferred apparatus and method according to the invention, which however are capable of expression in structure and method other than those particularly described and illustrated.

DETAILED DISCLOSURE

FIG. 1

Figure 1:
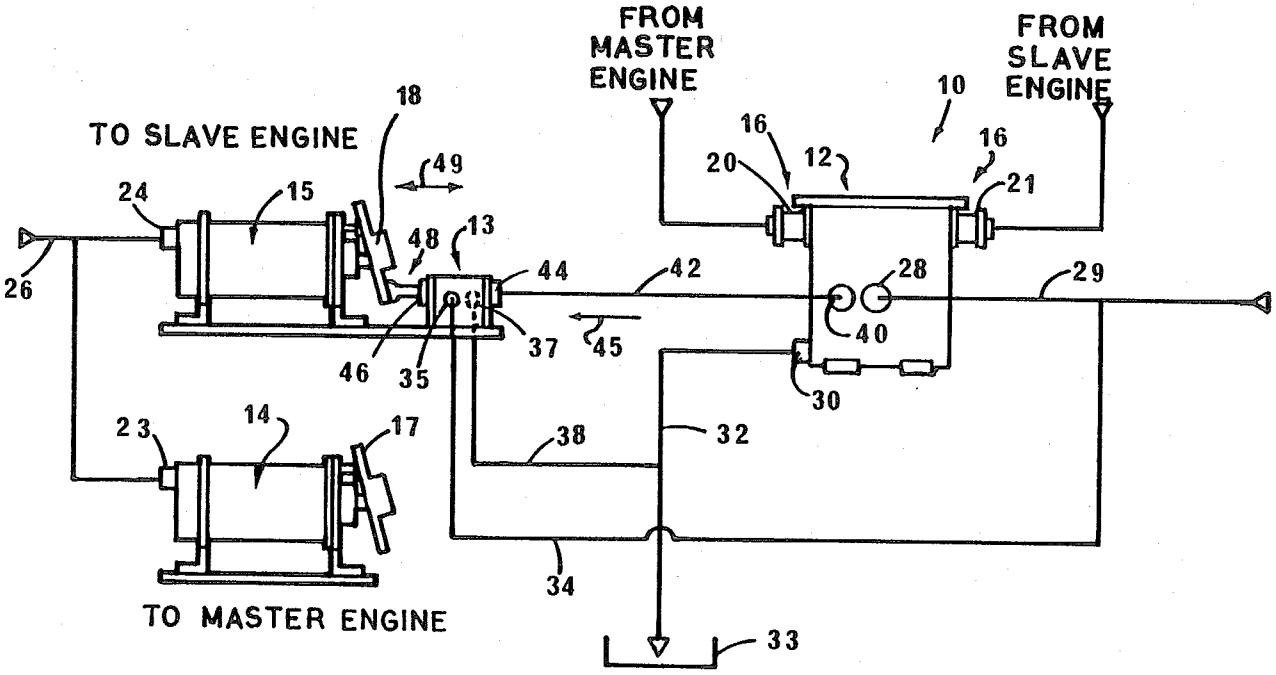
FIG. 1 is a simplified schematic showing main fluid actuating components according to the invention, and input and output means associated with the engines.

A load sharing apparatus 10 according to the invention has a load comparison means 12, a servo means 13 and master and slave engine throttle actuators 14 and 15 having outputs 17 and 18 respectively coupled to master and slave engines, not shown. The load comparison means 12 has a comparison input means 16 which includes comparison input ports 20 and 21 which receive turbo charger pressure signals from the master and slave engines respectively. Alternatively the ports 20 and 21 receive pressure signals reflecting fuel rack positions of the respective engine, or cooperate with other engine load transmitters for transmitting the load signal which reflects the load condition of the particular engine. The throttle actuators 14 and 15 have respective actuator inputs 23 and 24 connected to a throttle signal line 26 which receives a varying pneumatic throttle signal from an operator's manual control.

The load comparison means 12 has a power fluid input 28 which receives hydraulic power fluid under a constant supply pressure from a supply line 29, and a comparison power fluid exhaust 30 dumping fluid to a scavenge line 32 feeding to a sump 33. The servo means 13 has a servo fluid input 35 receiving hydraulic power fluid under the constant supply pressure from a servo input line 34 connected to the supply line 29, and a servo exhaust 37 connected to a scavenge line 38 returning fluid to the sump 33. The comparison means 12 has a comparison output means 40 being an output port connected to an output line 42 which communicates with a servo control input 44 of the servo means 13. As will be described with reference to FIGS. 3 through 5, the comparison output means 40 produces a differential signal, shown as arrow 45, reflecting comparison of the engine loads, which signal is fed to the servo means 13. The servo means has a servo output means 46 connected to a coupling means 48 which is coupled to the slave engine throttle actuator 15, the output means 46 providing a servo signal to the actuator 15, shown as an arrow 49 as will be described.

FIGS. 2 through 5

Figure 2:
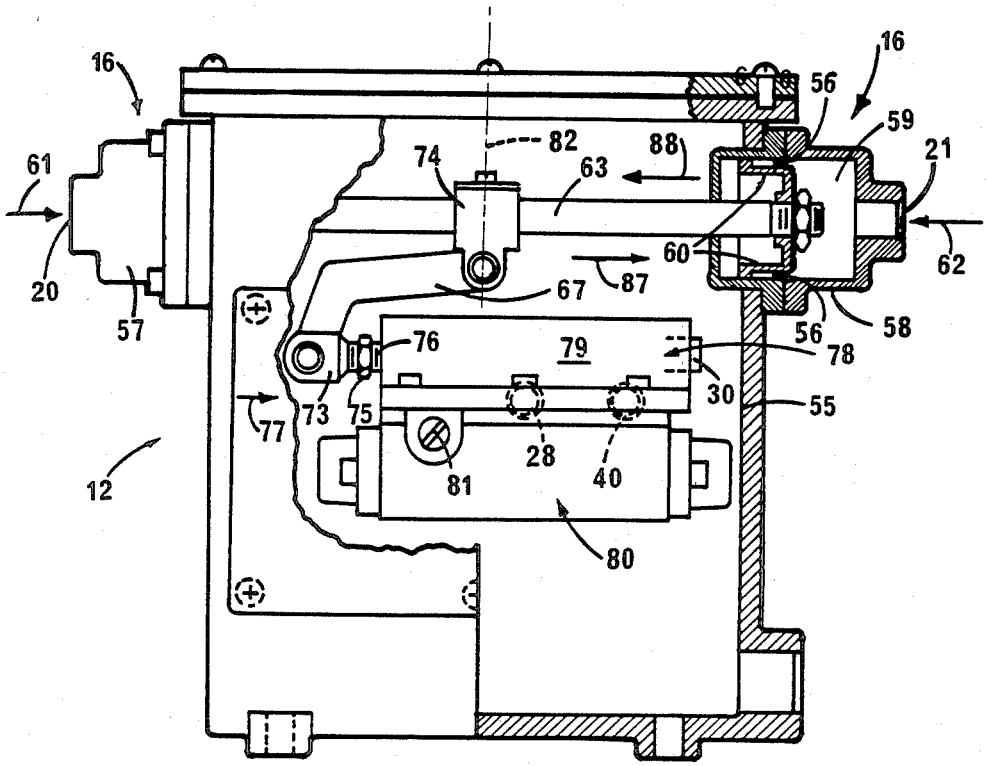
FIG. 2 is a simplified, partially fragmented side elevation of a comparison means according to the invention, some portions being omitted for clarity.

Referring to FIG. 2, the comparison means 12 has a casing 55 carrying the comparison input means 16 which includes two diaphragm compensator assemblies 57 and 58. The assemblies 57 and 58 cooperate with engine load transmitters to receive master and slave engine output load signals respectively reflecting load condition of the particular engine. The compensator assemblies 57 and 58 have diaphragm chambers communicating with the comparison input ports 20 and 21 to receive varying fluid input signals, shown as arrows 61 and 62, reflecting master and slave engine outputs. One diaphragm chamber 59 for the assembly 58 is shown, the other diaphragm chamber for the assembly 57 being similar. The assembly 58 has a flexible diaphragm 56 and supporting diaphragm cup 60, the cup and diaphragm being connected together at centres thereof following common practice. While air is the preferred signal fluid, hydraulic fluid can be substituted. The diaphragms of the assemblies 57 and 58 are movable in response in engine loads and are disposed oppositely to each other and are connected to a common output rod 63. The rod 63 serves as a force combining means which cooperates with the sensor elements, i.e., the diaphragms, and the rod is movable axially to reflect the difference in fluid pressure between the diaphragm chambers. This difference in fluid pressure reflects the difference in operating loads of the two engines and moves the rod 63 accordingly in response to net force on the rod. Alternatively, the diaphragms could be eliminated and low friction mechanical connections from engine load sensors to ends of the rod 63 could be used. The rod 63 has an output arm 67 having an output connector 73 which connects an outer end of the arm to a signal input rod 76 of a main fluid valve 78. The output arm 67 has an inner end hinged to a collar 74 which is adjustable axially of the rod 63 to provide a coarse adjustment. The signal input rod 76 has a locking nut and thread to provide a fine adjustment means 75 relative to the arm 67, the two adjustment means being used to provide a datum reflecting balanced load condition of the engine as will be described.

The main fluid valve 78 has a valve body 79 secured to the casing 55. The rod 76 can be moved axially relative to the body 79, and in the present specification an arrow 77 designates an inwards or retracting direction of movement of the rod 76 relative to the body. The valve body has the fluid power input means 28 to receive power fluid at constant pressure, the power fluid exhaust means 30 to vent power fluid to the sump, and the comparison output means 40 to discharge control fluid as required into the output line 42, not shown, which reflects the differential signal. The fluid means 28, 30 and 40 are shown as broken lines and are located on opposite side of the body. Movement of the signal rod 76 axially relative to the body varies output signal from the output means 40 as will be described with reference to FIGS. 3 through 5. A buffer piston assembly 80 and a flow control valve adjustment screw 81 cooperate with fluid output from the valve as will be described. It can be seen that the output arm cooperates with the comparison output means to produce a fluid signal, i.e., the differential signal, which is responsive to movement of the output arm from a datum or balanced engine output condition.

The comparison output means 40 outputs a differential signal which reflects relative position of the output arm 67 which in turn reflects difference in load between the master and slave engines. In FIG. 2, the engine loads are shown to be equal and the datum is shown as a broken line 82. Axial movement of the rod 63 and with it the output arm, in either direction from the datum or line 82 reflects a degree of imbalance of load output from the two engines. The output rod 63 is located at outer ends thereof by the diaphragm chambers so as to obtain essentially zero lost motion relative to the diaphragms, and is not supported in any other way so that friction losses are negligible. Springs are not required in the diaphragm chambers, and the diaphragms can be relatively thin so that hysteresis losses are also negligible. Adjustable stop means, not shown, can be provided to limit excessive axial movement of the arm 63. The diaphragms serve as sensor elements, and load signals from each engine are translated into movement of a respective sensor element. The sensor elements are in fact axially movable members adapted to move the rod 63 and the arm 67 relative to the datum, thus reflecting relative engine outputs. The amount of movement from this datum produces in the valve 78 a new setting reflecting the differential signal generated by the valve. If pressure is higher in the assembly 57 than in the assembly 58, the master engine is working harder than the slave engine and the rod 63 moves axially per arrow 87. Conversely, if the master engine works less than the slave engine which should not occur for any length of time in normal operating conditions, the rod moves per arrow 88.

The valve 78 and the buffer piston assembly 80 have internal flow control structure to be described with reference to FIGS. 3 through 5, and the fine adjustment means 75 associated with the rod 76 is adjusted so that when the arm 67 is in the balanced position as shown, that is adjacent the datum 82, input rod 76 is positioned to produce a datum differential signal from the valve which causes no change to the relative settings of either engine. This requires that there is no signal to change the engine setting of the slave engine. Thus, for equal load conditions of the master and slave engines, the sensor elements position the rod in the balanced or datum position as shown and there is no resultant change in engine load demand.

Figure 3:
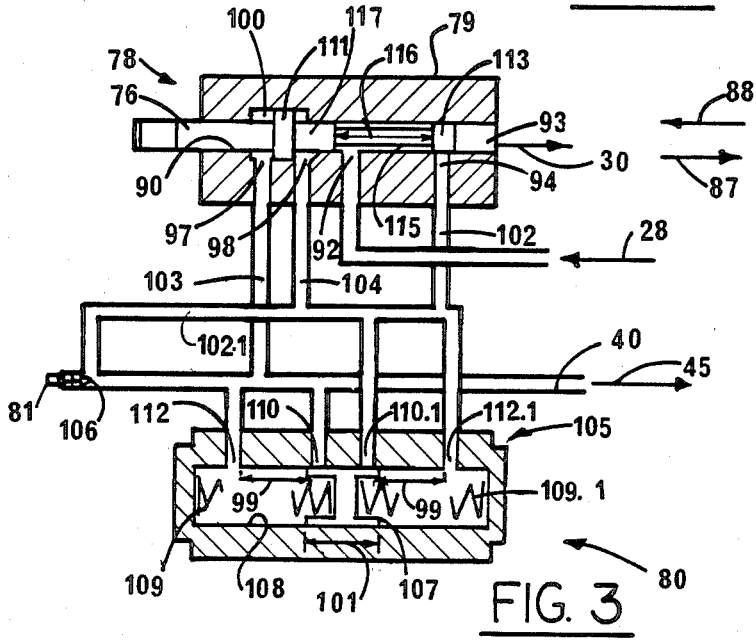
FIG. 3 is a simplified fragmented diagram of a control valve associated with the comparison means of FIG. 2, the valve being shown in an intermediate or balanced position resulting from an equal sharing of loads between the engines.

Referring mainly to FIG. 3, the valve body 79 of the valve 78 is shown simplified and schematically and has a main control bore 90 having axially spaced input and control fluid output ports 92 and 94 respectively. The control bore has a drain or exhaust port 93, and also first and second axially spaced compensation ports 97 and 98, the ports 97 and 98 being adjacent shoulders defining an enlarged portion 100 of the control bore. The input and exhaust ports 92 and 93 communicate with the power fluid input means 28 and power fluid exhaust means 30 respectively. The control port 94 communicates with the buffer piston assembly 80 through a control line 102. The compensation ports 97 and 98 communicate with the buffer piston assembly 80 through compensation lines 103 and 104 respectively, and with the control line 102 to feed into the common comparison output means 40, see FIGS. 1 and 2. The flow control valve adjustment screw 81 has a tapered needle 106 which cooperates with an extension 102.1 of the line 102 to control flow relative to the output means 40 and the control port 94, and between the differential ports 97 and 98. The needle 106 provides an adjustable time delay to adjust response of the overall apparatus, thus reducing "hunting" tendencies.

The buffer piston assembly 80 effectively is disposed between the compensation lines 103 and 104 and is adapted to absorb rapid signal changes should such changes occur. Excessively rapid changes can occur from failure of an associated component. The assembly 80 includes a buffer piston member 107 which is centered within a buffer cylinder 108 by a pair of compression coil springs 109 and 109.1. The cylinder 108 has a first and second inner buffer ports 110 and 110.1, and first and second outer buffer ports 112 and 112.1.

The buffer piston member 107 has an axial length 101 which is somewhat greater than spacing between the inner buffer ports 110 and 110.1. This is to permit a small movement of the member 107 from the central position without opening either inner buffer port, which provides a small increase in volume on one side of the member 107 to accommodate a small excess of fluid. This is the normal range of movement, and the buffer piston assembly can be ignored within this range when considering operation of the device. To accommodate a moderate increase in fluid on one side of the piston member 107, the piston shifts further and exposes one of the inner ports 110 or 110.1. This increased displacement of the member 107 is a result of a more rapid load change as will be described with reference to FIG. 4. Port spacing 99 between the first pair of inner and outer ports 110 and 112, or the second pair of inner and outer ports 110.1 and 112.1, is sufficient for the buffer piston to close one only of the first pair of ports, e.g., 110 or 112, or one only of the second pair of ports, e.g., 110.1 or 112.1.

Figure 5:
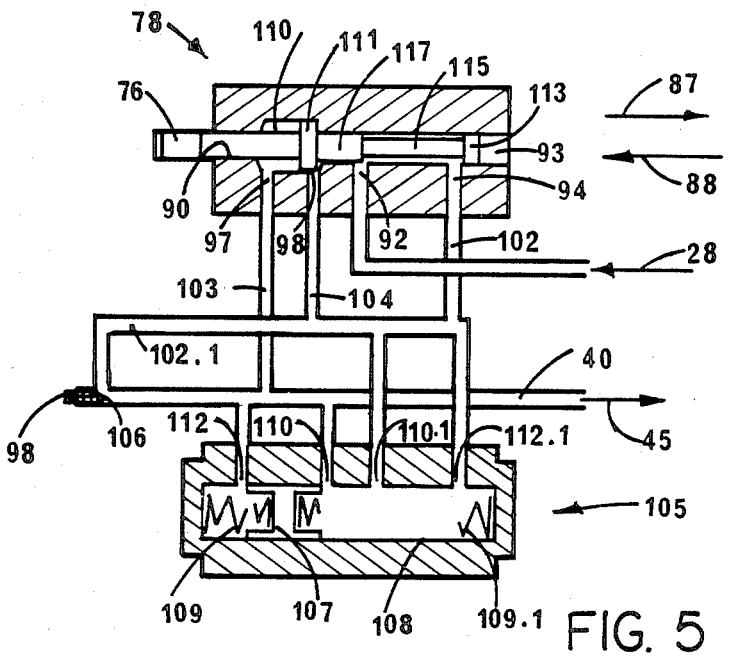
FIG. 5 is a simplified section similar to FIG. 3 with the valve being shown in a retracted position resulting from the master engine "working harder" than the slave engine.

As seen in an extreme displaced position in FIG. 5, which could represent a situation reflecting component malfunction, the buffer piston member 107 cannot close simultaneously adjacent pairs of ports 110 and 112 or 110.1 and 112.1.

The comparison output means or line 40 interconnects the first inner and first outer ports 110 and 112 to the needle 106 and first compensation port 97. The connecting line 102.1 connects the second inner and second outer ports 110.1 and 112.1 to the second compensation port 98 and the control port 94 and the opposite side of the needle 106. Both inner ports 110 and 110.1 are shown closed by the buffer piston member in the centred position. As will bé described, excess pressure difference across opposite ends of the buffer piston member causes it to shift axially, thus exposing one or other of the inner buffer ports and quickly increasing available volume of the buffer cylinder on one side of the piston to accommodate excessive fluid. This would normally only be used when there was a failure somewhere else in the system, and a sudden transfer of engine load occurred. The differential signal is generated from the discharge side of the needle 106 and passes into the comparison output means 40 as designated by the arrow 45.

The signal input rod 76 is shown simplified and schematically and has a main diameter for most of its length which is compatible for sliding and fluid control within the control bore 90 of the valve. The rod 76 has compensation land 111 having a diamerter greater than the main diameter of the rod and is compatible with the diameter of the enlarged portion 100 of the control bore. The compensation land has a thickness sufficient to fit between the first and second compensation ports 97 and 98 and is adapted for limited axial movement within the enlarged portion 100. The signal input rod has a control land 113 having a diameter equal to the main diameter of the bore 90 and has a clearance portion 115 having a diameter less than the main diameter. The clearance portion 115 has a length 116 defined by spaced apart shoulders and extends between the control land 113 and an inner rod portion 117 which has a diameter equal to the main diameter and is adjacent the compensating land 111. It can be seen that the main bore has the control port 94 positioned between the exhaust and input ports 93 and 92, and the input port is spaced from the control port by an amount approximately equal to the length 116 of the clearance portion 115. The first and second compensation ports are spaced apart sufficiently to accept the compensation land therebetween, with the compensation port being exposed to pressure of fluid passing from the control port 94. The exhaust port 93 serves merely as a drain to discharge under low pressure fluid that leaks past the control land 113.

FIG. 3 shows the rod 16 in an equilibrium or balanced position in which the control land 113 is positioned adjacent the control port 94 so as to essentially close the port 94. This represents a state where the load transmitters of the slave and master engines are indicating equal power and thus no change in slave engine thrutle setting is required. The compensation land 111 is positioned between the two ports 97 and 98, and in this position the differential signal has a particular equilibrium pressure which is maintained by closing the port 94 and preventing any significant change in output pressur at the comparison output means 40. The buffer piston is centered and closes both inner buffer ports. The position shown in FIG. 3 represents the desired position which unbalanced load conditions shown in FIGS. 4 and 5 attempt to regain by adjusting the slave engine load, as will be described.

Figure 4:
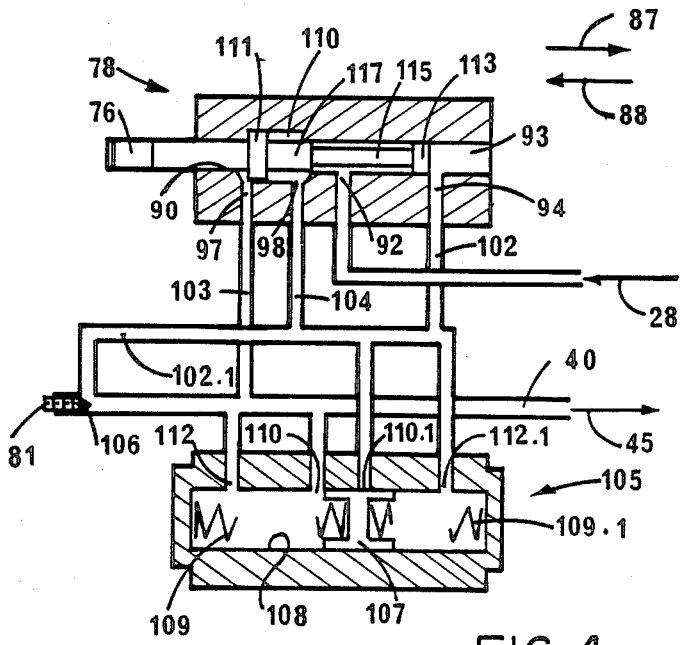
FIG. 4 is a section similar to FIG. 3 with the valve being shown in an extended position resulting from slave engine "working harder" than the master engine.

FIG. 4 shows the input rod 76 in an extreme extended position in which the compensation land 111 is adjacent an outer shoulder of the enlarged portion 100 of the bore. In this position there is still clearance for fluid communication on both sides of the land 111, i.e., the land 111 does not close the compensation port 97. The control land 113 is disposed between the input port 92 and the control port 94 so that essentially no additional fluid can enter the input port. This represents an extreme condition of a lower pressure signal output from the comparison means 40, because in this condition pressure in the output means 40 drops by fluid passing the screw 106 and flowing through the port 94 and into the bore 90 to exhaust, thus reducing pressure of the differential signal. The buffer piston is shown momentarily displaced in direction of the arrow 87 due to a momentary pressure drop in the line 102, and in this position the port 110 is opened to admit additional fluid volume and to cause a similar pressure drop in the line 40 which assists in re-entering the buffer piston. With reference to FIG. 2, the extreme outer position of the rod 76 is attained when the output rod 63 contacts left hand stop means, not shown, after moving in the direction of an arrow 88 towards the diaphragm assembly 57. This reflects a slave engine load greater than master engine load, that is the slave engine is "working harder" than the master engine which should never occur, except in an emergency situation.

FIG. 5 represents an opposite extreme condition in which the rod 76 is in an extreme retracted position, resulting from the rod 63 and arm 67 (FIG. 2) moving in direction of the arrow 87 towards the diaphragm assembly 58. This reflects a master engine load greater than the slave engine load, that is the slave engine is not working hard enough. In this condition the compensating land 111 is adjacent an inner portion of the enlarged portion 100 of the control bore and, similarly to the extreme position shown in FIG. 4, the compensation land does not close the compensation port 98. Now the control land 113 is clear of the control port 94, and the clearance portion 115 of the input rod extends between the input port 92 and the control port 94 to permit additional fluid to flow through the valve from the port 92 to the port 94, increasing fluid pressure in the control line 102 and the output means 40 as will be described. A momentary increase in pressure in the line 102 would cause the buffer piston to shift slightly per arrow 88, which would open the port 110.1 and maintain the port 110 closed. This would be equal and opposite to the position of the buffer piston as shown in FIG. 4. However, if there were a sudden sustained increase in pressure in the line 102, for example due to component malfunction, the buffer piston could shift further in the same direction until it opened the port 110 also as shown. This connects the line 102 to the line 40 through the buffer cylinder 100, thus bypassing the needle 106 and permitting a more rapid transfer of fluid volume and pressure.

The positions of the input rod and buffer piston shown in FIGS. 4 and 5 represent extreme conditions of load differences which likely would not occur due to a compensating effect of the compensating land 111, which tends to reduce excessive fluctuations of the signal rod due to a negative feedback effect, as will be described.

FIG. 6

Figure 6:
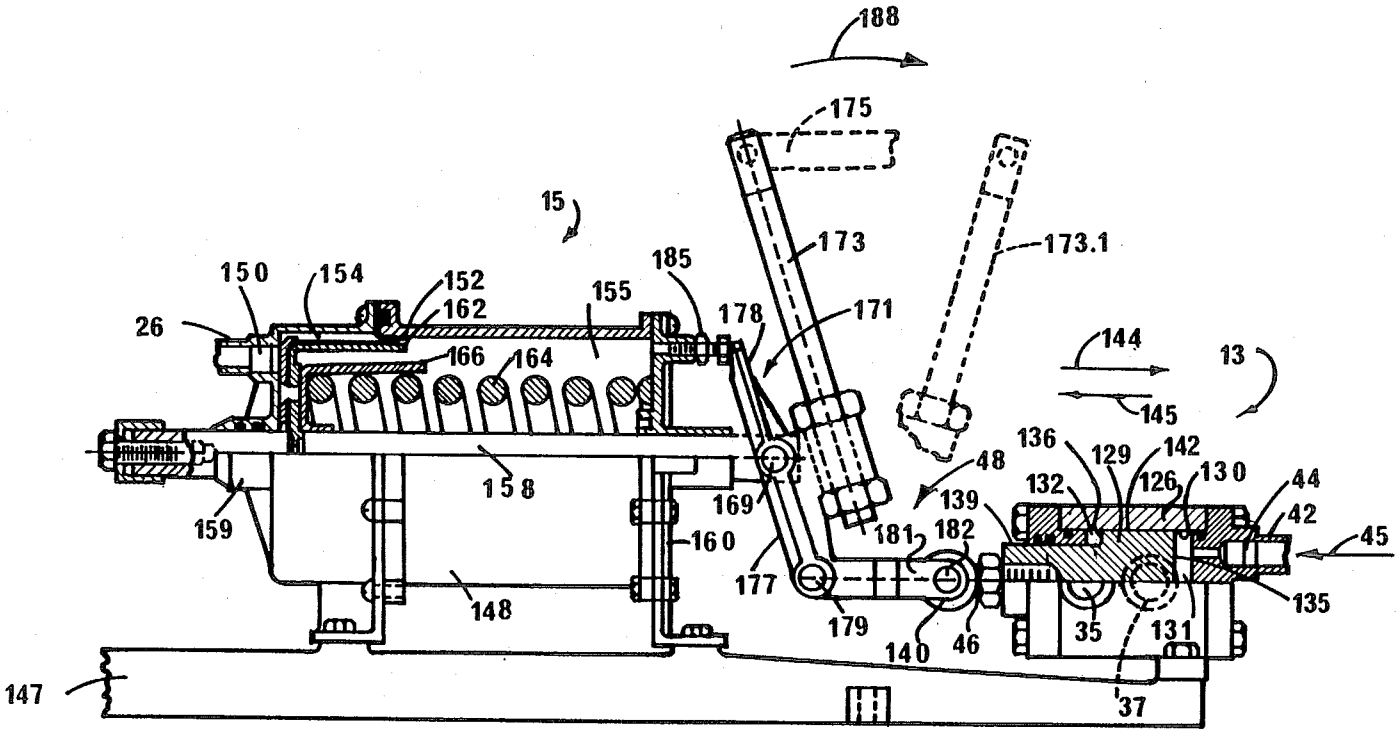
FIG. 6 is a simplified, partially fragmented, side elevation and section through a servo means according to the invention, showing cooperation with a component associated with a slave engine speed control means.

The servo means 13 and slave engine throttle actuator 15 are coupled together to produce a single signal to the speed control means of the particular slave engine by structure as will be described. The throttle actuator 14 of the master engine (shown in FIG. 1 only), is directly coupled to the speed control means of the master engine, without an intervening servo means as shown in FIG. 6. The basic throttle actuators 14 and 15 are structurally generally similar and thus the actuator 14 is not discussed in detail. Also, many portions of the throttle actuators are known, and thus only important structure will be described.

The servo means 13 has a servo body 126 having the servo fluid input 35 to receive pressurized control fluid from the line 29, (FIG. 1), and the servo exhaust 37 (broken outline) to dump control fluid to the scavenge line 38 (FIG. 1). The servo body also has the servo control input 44 which communicates with the output line 42 and receives the control fluid from the comparison means 12 reflecting the differential signal 45. The servo means also has a servo-piston 129 which is slidable within a bore 130 of the body, the servo piston defining first and second chambers 131 and 132 within the body which are disposed adjacent first and second faces 135 and 136 respectively of the servo piston. The piston has a servo piston rod 139 extending from the body to an outer end 140 to provide the servo output shaft or means 46. The servo piston rod extends through the second chamber so that the second face 136 of the piston 129 has a smaller effective area than the first face 135. In this instance, the area ratio is 1:2, that is the second face 136 has an area that is one half of the area of the first face 135. The first chamber receives fluid from the port 44, that is control fluid from the comparison means reflecting the differential signal 45, and the second chamber receives the power fluid through the port 35 at the constant supply fluid pressure. The piston 129 has a grooved periphery 142 in close contact with a cylinder wall of the bore 130, the groove limiting flow of fluid past the piston. Any fluid or air passing the piston can be scavenged through the servo exhaust 37, which serves as fluid drain means to exhaust a small amount of leakage. The piston means thus serves as a partition means movable relative to the servo body in response to difference between forces exerted on the piston by fluid under differential signal pressure from the comparison means acting on the first face 135, and the fluid under supply pressure acting on the second face 136. The control fluid from the output line 42 in the first chamber 131 has a varying pressure depending on the differential signal and can never exceed supply pressure in the line 29. Fluid from the lines 29 and 34 (FIG. 1) in the second chamber 132 is always at supply pressure. Thus, the difference in the fluid pressures acting on the different effective areas of the first and second faces of the piston results in a net force on the piston 129. The net force can be zero, in a balanced engine load condition, or can act in either direction on the piston, thus causing axial movement of the piston rods 139.

The valve 78 is designed so that in the equilibrium position of FIG. 3 the differential signal in the output means 40 i.e., in the chamber 131 (FIG. 6), is at a pressure of one half of the supply pressure 132. Thus, at a balanced engine load condition, the ratio of the differential signal pressure to the supply pressure is 1:2. Because the corresponding ratio of piston areas in the chambers 132 and 131 is 1:2, the forces on opposite faces of the piston are equal and the net force on the piston is zero. Thus the piston 129 does not move, there is nor resultant servo signal, and there is not change in throttle setting of the slave engine. Clearly, a different area ratio of opposite piston faces would require a corresponding different ratio of equilibrium differential signal pressure to supply pressure. If the slave engine is working harder than the master engine, as depicted in FIG. 4, the differential pressure signal in the chamber 131 is lower than equilibrium pressure, resulting in a net force on the piston in direction of an arrow 144, thus retracting the rod 139. Correspondingly, when the slave engine is working less than the master engine, as depicted in FIG. 5, there will be a net force acting on the servo piston in direction of an arrow 145, thus tending to extend the servo piston rod 139.

The servo body 126 is secured to a base plate 147 which carries an actuator body 148 of the slave engine throttle actuator 15, thus maintaining these two components at a fixed spacing. The body 148 has an input port 150 connected to the line 26, FIG. 1, and thus is an input means adapted to receive the initial throttle signal from the operator. The throttle actuator has a flexible diaphragm 152 dividing the interior of the body 148 into a diaphragm chamber 154 and a spring chamber 155. An output rod 158 is mounted in aligned bores in and caps 159 and 160 of the actuator, and carries a diaphragm holder 162 which locates the diaphragm to prevent pinching thereof. A compression coil spring 164 extends between the end cap 160 and a spring retainer 166 which is held against the diaphragm holder by force from the spring. The spring encircles the output rod and forces the diaphragm 152 and holder towards the end cap 159, thus tending to diminish volume of the diaphragm chamber 154. The output rod 158 has an outer end passing through the end cap 160 and carrying a hinge pin 169.

The actuator 151 has an output means having an output member 171 hinged on the pin 169 with a first portion 173 connected to a fuel rack 175, broken outline, of a diesel engine, now shown, the rack being a speed control means of the engine. The output member 171 has a second portion 177 extending rigidly from the portion 173 and carrying a hinge pin 179 which journals a short connecting link 181 which extends to a pin 182 carried on the outer end 140 of the servo piston rod 139. The link 181, the member 171 and associated structure and pins serve as the coupling means 48 to couple the servo output means to the second portion of the actuator 15 to receive the servo signal from the servo means. The output member 171 also has a stop arm 178 which also extends rigidly from the portion 175 and is adapted to contact an adjustable stop means 185 carried on the end cap 160, so as to limit swinging of the output member 171 about the pin 169. It can be seen that if the output rod 158 remains essentially stationary as shown, extension of the servo piston rod 139 in direction of the arrow 145, resulting from the slave engine working less than the master engine, causes the first portion 173 to swing in direction of an arrow 188 towards a broken outline position 173.1 reflecting a greater demand on the fuel supply of the slave engine. Correspondingly, if the servo piston rod 139 remained fixed and the output rod 158 were extended in direction of an arrow 144 as a result of an increase in the initial throttle signal in the input 150, there would be a corresponding swinging of the first portion 173 of the output member 171 to the position 173.1. It is seen that the initial throttle signal and the servo signal are, in effect, combined by the output member 171 which acts as a rocker shaft to rock about the hinge pin 169, and the first portion 173 is moved as required to form the resultant throttle signal to control the speed control means of the slave engine.

OPERATION

Referring to FIG. 2, load signals from the master and slave engines are fed into the comparison input means 16, which signals are either fluid signals from the turbu charger, or fluid signals or mechanical displacements generated by movement of the respective fuel racks of the engines. The output rod 63 moves in response to the pressure signals in the diaphragm assemblies 57 and 58, causing a corresponding movement of the output arm 67. If the engines were originally delivering equal power, and then a difference develops between power delivered, the amount of movement of the arm 67 from its equilibrium position 82 is proportional to the power difference i.e., difference between the two engine load signals. As previously stated, FIG. 3 shows the valve 78 in the equilibrium position in which the control land 113 of the signal input rod 76 blocks the control port 94 and the pressure of the differential signal generated by the main valve 78 is one half of the supply pressure. Blockage of the port 94 by the land 113 prevents flow in the line 40, and thus pressures are equal on each side of the needle 106. Thus pressures in the compensation lines 103 and 104 are equal and fluid forces on the differential land are balanced by equal pressures on each side thereof. Thus there is no set feedback force tending to move the rod 76 which remains in the centred position until an imbalance in engine loading occurs.

If the slave engine started delivering less power than the master engine, the output arm 67 would move from the balanced or equilibrium position 82 of FIG. 2 in direction of the arrow 87. This would result in the signal input rod being depressed further into the main valve 78. In FIG. 5, movement of the rod 76 per arrow 87 causes the control land 113 to uncover the control port 94 and to pass additional fluid from the input port 92 to the control port 94 by passing the clearance portion 115. This causes an increased pressure flow from the port 94 which is metered by the needle 106 to a slightly lower pressure and passes into the output means 40 to be transmitted to the servo means 13, FIG. 6. For a normal rate of change of engine loading, the buffer piston 107 is also exposed to this higher pressure and would move negilegibly to increase available volume, but this does not affect the following description. Increased pressure of control fluid from the control port 94 in the line 104 applies an increased force on the differential land 111 in direction of the arrow 88. Fluid in the line 103 is also at the slightly lower pressure due to metering by the needle 106 and applies a lesser force on the opposite side of the land 111, which lesser force is overcome. Thus the input rod 76 is moved oppositely to the arrow 77, and this tendency is transferred through the arm 67 back to the rod 63 of FIG. 2. This movement of the rod 63 is in opposition to the load signals from the engines. Thus the relatively fast pneumatic signal of engine load is opposed by the slower hydraulic signal of the servo means. Thus a feedback force is generated by fluid forces acting on the rod 76, tending to centre the rod 76 to maintain the position as shown in FIG. 3. This is a relatively slow response negative feedback system with a limited positioning force, and speed of response can be adjusted by the screw 81 controlling the needle 106. It can be seen that the negative feedback effect on the input rod 76 acts in an opposite direction to the initial movement, and this tends to reduce "over-shoot" and- /or "under-shoot" of the system, with corresponding reduction in hunting tendencies.

If the rate of change of engine loading is relatively sudden and short lived, the buffer piston 107 shifts in direction of the arrow 88 and opens the port 110.1 and maintains the port 110 closed which is a more usual situation and its opposite condition is shown in FIG. 4. However for a rapid and sustained master engine overland condition, the piston 107 could shift to the more extreme position shown in FIG. 5. This not only produces a considerable increase in volume to receive the additional fluid from the line 102, but also permits fluid to bypass the neddle 106 so as to provide an unmetered connection via the buffer cylinder 108 between the lines 102 and 40. Thus causes a higher pressure on the differential signal which results in a more rapid change in engine control signal. In this more rapid shift where the lines 40 and 102 are connected together bypassing the needle 106, the lines 103 and 104 are at essentially equal pressure and the feedback forces on the rod 76 is temporarily reduced or eliminated. Usually this extreme condition would only last for a short time, e.g., a few seconds, before the load imbalance was corrected.

During this period, the fluid at the slightly reduced pressure leaves the comparison means through the output means 40 as the differential signal, designated as the arrow 45. The drop in control pressure due to metering of fluid passing the clearance 115 and the needle 106 produces a differential signal which is at a pressure somewhat greater than that for the equilibrium position.

Referring to FIG. 6, the unbalanced differential signal generated by the rod shown in the position of FIG. 5 is at a pressure which is slightly greater than one half of the constant supply pressure of the power fluid. This differential signal pressure is fed into the first chamber 131 of the servo means 13 and applies a force on the servo piston 129 in the direction of the arrow 145, which is opposite to the force from the constant supply pressure in the second chamber 132. Because the face 135 is twice the area of the face 136, and the face 135 is subjected to pressure greater than one half of that acting on the face 136, there is a resultant force on the servo piston in direction of the arrow 145. Thus the hinge pin 182 moves similarly, which causes a rocking of the output member 171 in direction of the arrow 188 towards the broken outline position 173.1. It should be noted that the throttle actuator 15 is drawn in an idle position, whereas the servo means is shown in a position demanding increased RPM from the slave engine.

In the opposite situation, which rarely occurs except in a failure of some portion of the system, the slave engine momentarily can work harder than the master engine, and the reverse sequence of events occurs. For example, with reference to FIG. 2, the rod 63 moves per arrow 88 and the arm 67 withdraws the signal input rod 76 from the main fluid valve 78 to assume the position shown in FIG. 4. In this position the power fluid at the input port 92 is restricted from leaving the valve, apart from minor leakage through the exhaust port 93. The control port 94 is now exposed to exhaust and this permits loss of fluid pressure through the port 94, thus reducing pressure in the in the line 102 and the line 104 on one side of the land 111. Because of flow restriction by the needle 106, this pressure loss in the line 102 is not transmitted immediately to the line 40, and thus fluid in the line 104 is momentarily at a pressure lower than that in the line 103. Residual fluid pressure in the line 103 applies a force on the differential land 111 which overcomes the opposing fluid force and moves the rod 76 in the direction of arrow 87, i.e., back towards the equilibrium position. This acts as the slow response negative feedback system as previously described with reference to FIG. 5 for the opposite load imbalance. The pressure of the differential signal in the line 40 is reduced slowly by restricted flow past the needle 106 from the line 102. Again, with very sudden engine load changes, the buffer piston could shift to assume an extreme condition in which both inner ports 110 and 110.1 are opened, to permit fluid to bypass the needle 106. This is not illustrated in FIG. 4, nor is it common.

Referring to FIG. 6, fluid pressure in the first chamber 131 of the servo means decreases due to decrease in differential signal pressure in the line 42 to a pressure less than one half of the control pressure. The pressure difference between the fluid in the chambers 131 and 132 acts on the differential piston areas and causes the servo piston 129 to move in the direction of the arrow 144. During this movement of the piston 129, the output member 171 is rotated in a direction opposite to the arrow 188, thus swinging the first portion 173 in a similar direction so as to reduce fuel demand to the slave engine, thus reducing power of the slave engine. This continues until the signal input rod 76 assumes the balanced position shown in FIG. 3, wherein the control port is closed by the control land 113, at which time the servo piston ceases to move.

It can be seen that when the differential signal is one half of the constant supply pressure, the servo piston has equal forces on each side thereof and is held in a fixed position. Also, the control land 113 closes the control port 94 and correspondingly closes the output line 42 extending to the servo means so that the servo piston is also hydraulically locked within the servo means. This further prevents movement of the output member 171, unless of course there is a change in throttle signal from the control head, which would then disturb the equilibrium position, resulting in servo piston movement. The difference of the differential signal from one half of the supply pressure represents inequality of power output between the master and slave engines. This is assuming that the area ratio of the servo piston is exactly 1:2. Clearly, if the servo piston area ratio is not 1:2, the ratio of the equilibrium or balanced differential signal to the constant supply pressure would be different.

In summary, some important parameters relating to the invention are as follows. The equilibrium pressure of the differential signal, i.e., balanced engine load condition, is at a particular ratio to the constant supply pressure. The second face 136 of the servo piston 129 has a smaller effective area than the first face 135, and a ratio of the areas of the first face to the second face is equal to the ratio of the supply pressure to the equilibrium pressure.

The above describes several types of conditions of unbalanced load correction but normally the buffer piston remains essentially stationary and centred in the cylinder 108, maintaining the ports 110 and 110.1 closed. If there were a hydraulic pressure failure, a sudden fluid surge into either of the outer ports 112 or 112.1 could be accommodated by a corresponding movement of the piston 107. Only during a servere load imbalance would both inner buffer ports be exposed, as shown in FIG. 5, to dump excessive fluid into either line 102.1 or 40.

In summary, it can be seen that the load sharing apparatus of the invention has a load comparison means having a comparison input means to receive load signals from each engine, and a comparison output means to produce a differential signal reflecting comparison of the engine load signals. The apparatus also includes a servo means having a servo control input adapted to receive the differential signal from the comparison means, and the servo output means producing a servo signal in response to the differential signal. The differential signal is a pressurized control fluid signal, and the servo means permits the differential signal to act against a constant force. The apparatus also has a coupling means to couple the servo output means to the throttle actuator of the slave engine, so as to change the initial throttle signal to the slave engine by an amount dependent on the modified differential signal to form a resultant throttle signal to the slave engine. It is clear that a non-equilibrium differential signal from the comparison means reflects an imbalance between load signals transmitted from each engine. The differential signal is at a mean pressure reflecting the balanced load condition, which mean pressure is between upper and lower differential signal pressures which are generated to demand increased fuel to the slave engine, or decreased fuel to the slave engine respectively. The differential signal is continuously applied against constant pressure of power fluid, and as the differential signal varies from the mean pressure, there is a corresponding movement of the servo piston to correct the variation, so as to bring it back to the mean pressure. The differential land in the valve means provides a means of opposing the initial rod movement due to fast response pneumatic signals and reduces over-shooting or under-shooting following a change in differential signal, by establishing a temporary negative feedback signal using the slower response hydraulic signals, which in return reduces a hunting tendency. The differential land and associated lines provide a negative feedback system within the comparison means to combine a feedback signal reflecting the differential signal with the two engine load signals to produce the differential signal in such a manner that over-shooting or under-shooting problems are reduced.

In summary, it can be seen that a method according to the invention is for sharing loads between coupled master and slave engines having respective throttle actuators to receive initial throttle signals, and load transmitters for transmitting load signals for reflecting load on the particular engine. The method includes the steps of comparing loads, producing a servo signal and changing the initial throttle signal in response to the servo signal as follows. Load signals from each engine are compared and a differential signal is produced to reflect the comparison of said load signals. The differential signal acts against a constant force to produce as a servo output a servo signal in response to the differential signal. For a balanced engine load condition, the differential signal is balanced by the servo piston and there is no change in slave engine setting. For an unbalanced engine load condition, the differential signal is not balanced, causing a change in slave engine setting. The initial throttle signal to the slave engine is changed by an amount dependent on the servo signal to form a resultant throttle signal to the slave engine, which is sustained until the balanced engine load condition is attained. If required, a relatively slow response hydraulic negative feedback signal can be combined with the differential signal in such a manner that over-shoot and/or under-shoot tendencies are reduced.

ALTERNATIVES AND EQUIVALENTS

The buffer piston assembly 105 is an added feature that is not essential to the basic operation of the apparatus. The piston assembly and associated lines can be elimiated and suitable connections substituted to maintain fluid communication on either side of the differential land 111, so as to maintain the negative feedload advantages as described. The comparison means is adapted to receive air signals from the engines reflecting engine load condition. These signals are preferably taken from the turbo charger manifold, but a direct mechanical connection between the fuel rack of each engine to the rod 63 can be substituted, if practical. This would eliminate use of air signals and the diaphragm chambers as illustrated. Furthermore, alternative throttle actuators can be used wherein the throttle signal from the control head can be other than an air pressure signal, and can in fact be mechanical or hydraulic. In the alternatives, means should be provided to combine the servo signal from the servo means 13 to the initial throttle signal applied to the throttle actuator, so as to produce the resultant throttle signal for direct coupling to the speed control means of the slave engine. Clearly, means other than a hinged output member similar to the member 171 can be devised, with suitable adjustment of the effect of the initial throttle signal and the modified differential signal.

I claim:

1. A load sharing apparatus for sharing loads between coupled master and slave engines, the apparatus including:

(a) load comparison means having a comparison input means to receive load signals from each engine, and having a comparison output means to produce a differential signal reflecting comparison of the engine load signals, the differential signal being a pressurized control fluid signal.

(b) servo means having a servo control input adapted to receive the differential signal from the comparison output means, and a servo output means producing a servo signal in response to the differential signal, the servo means permitting the differential signal to act against a constant force, (c) coupling means to couple the servo output means to a throttle actuator of the slave engine to change an initial throttle signal to the slave engine by an amount dependent on the servo signal to form a resultant throttle signal to the slave engine.

2. An apparatus as claimed in claim 1 in which:

(a) the comparison input means are sensor elements adapted to move in response to load signals from each engine, (b) the load comparison means includes force combining means adpated to cooperate with the sensor elements such that forces from the sensor elements act in opposition on the force combining means to produce the differential signal which is responsive to difference in operating loads of the engine.

3. An apparatus as claimed in claim 2 in which:

(a) the force combining means includes an output shaft which is movable axially about a datum reflecting a balanced engine load condition, (b) the sensor elements are axially movable members adapted to cooperate with opposite ends of the output shaft to move the shaft relative to the datum in response to forces from the sensor elements, (c) the comparison output means is responsive to signal input means cooperating with the output shaft to produce a movement relative to the datum to generate the differential signal.

4. An apparatus as claimed in claim 3 in which:

(a) the comparison output means has a main fluid valve having a valve body with a main bore, a power fluid input means to receive power fluid at a constant supply pressure, a power fluid exhaust means to vent power fluid, and a control fluid outlet means to discharge control fluid as required to reflect the differential signal, (b) the main bore has spaced input, exhaust and control ports to communicate with the power fluid input means, the exhaust means and the control fluid output means, and the signal input means is a signal input rod mounted within the main bore for relative movement therebetween to as to close or communicate respective ports as required to control output from the comparison output means.

5. An apparatus as claimed in claim 4 in which:

(a) the differential signal represents a degree of inequality between the power output of the master and slave engines, (b) the signal input rod has a main diameter compatible with the control bore, a compensation land having a diameter greater than the main diameter, a control land having a diameter equal to the main diameter, and a clearance portion having a diameter less than the main diameter and extending between the control land and an inner rod portion having a diameter equal to the main diameter and adjacent the compensation land, (c) the main bore has the control port positioned between the exhaust and input ports, and the input port is spaced from the control port by an amount approximately equal to length of the clearance portion, the main bore having first and second compensation ports which are spaced apart sufficiently to accept the compensation land therebetween, both of the compensation ports communicating with the control port.

6. An apparatus as claimed in claim 1 in which the servo means has a servo body and is characterized by:

(a) a servo fluid supply input to receive pressurized power fluid at a constant supply pressure, and the servo control input receives the control fluid as required reflecting the differential signal from the comparison means, (b) a partition means movable relative to the servo body in response to difference between forces exerted thereon by the control fluid at a pressure reflecting the differential signal from the comparison means and by the power fluid at the essentially constant supply pressure.

7. An apparatus as claimed in claim 6 in which the servo means is further characterized by:

(a) the partition means being a piston slidable within the servo body, the piston defining first and second chambers disposed adjacent first and second faces respectively of the piston, the piston having a servo piston rod extending from the body to provide the servo output means, the first chamber receiving fluid from the comparison means representing the differential signed, and the second chamber receiving the power fluid at the essentially constant supply pressure, (b) fluid drain means to exhaust fluid passing the piston.

8. An apparatus as claimed in claim 7 further characterized by:

(a) the pressure of the differential signal reflecting a balanced engine load condition is termed equilibrium pressure and is at a particular ratio to the constant supply pressure, (b) the servo piston rod extends through the second chamber so that the second face of the piston has a smaller effective areas than the first face, and a ratio of the areas of the first face to the second face is equal to the ratio of the supply pressure in the equilibrium pressure.

9. An apparatus as claimed in claim 1 in which the throttle actuator of the slave engine is an actuator positioner having:

(a) input means adapted to receive the initial throttle signal, (b) an output means reflecting the initial throttle signal, the output means including an output member having a first portion connectable to a speed control means of the engine, and a second portion being coupled to the servo output to receive the servo signal from the servo means, the initial throttle signal and the servo signal being combined to move the output member as required to form the resultant throttle signal to control the speed control means of the slave engine.

10. An apparatus as claimed in claim 1 in which:

(a) each engine has a load transmitter including a diaphragm compensator assembly having a diaphragm chamber adapted to receive air signals reflecting load condition of the particular engine, the diaphragm compensator having an output which is movable axially and reflects air pressure within the diaphragm chamber and thus engine load.

11. An apparatus as claimed in claim 10 in which the load comparison means is further characterized by:

(a) force combining means adapted to cooperate with each diaphragm compensator assembly, the diaphragm assemblies applying to the force combining means forces in opposite directions, the force combining means cooperating with the comparison output means to assist in generating the differential signal.

12. An apparatus as claimed in claim 1 further including:

(a) a negative feedback system cooperating with the load comparison means to combine a feedback signal reflecting the differential signal with the two engine load signals to produce the differential signal in such a manner that over-shoot and/or undershoot problems are reduced.

13. A method of sharing loads between coupled master and slave engines the method including steps of:

(a) comparing load signals from each engine and producing a differential signal to reflect the comparison of said load signals, (b) permitting the differential signal to act against a constant force to produce as a servo output a servo signal in response to the differential signal, (c) changing the initial throttle signal to the slave engine by an amount dependent on the servo signal to form a resultant throttle signal to the slave engine.

14. A method as claimed in claim 13 further characterized by:

(a) varying the differential signal to represent a degree of inequality between power outputs of the master and slave engines and in such a manner that the differential signal representing balanced power output is a pressure between upper and lower differential signal pressures.

15. A method as claimed in claim 13 or 14 further characterized by:

(a) combining a negative feedback signal with the two engine load signals to produce the differential signal in such a manner that over-shoot or undershoot tendencies are reduced.

16. A load sharing apparatus for sharing loads between coupled master and slave engines, the apparatus including:

(a) load comparison means having a comparison input means, a force combining means, and a comparison output means, the comparison input means having sensor elements adapted to receive load signals from a respective engine and being adapted to move in response to the load signal from the respective engine, the force combining means being adapted to cooperate with the sensor elements such that forces from the sensor elements act in opposition to each other on the force combining means to produce a differential signal at the comparison output means which reflects comparison of engine load signals, and reflects difference in operating loads of the engine, (b) servo means having a servo control input adapted to receive the differential signal from the comparison output means, and a servo output means producing a servo signal in response to the differential signal, (c) coupling means to couple the servo output means to a throttle actuator of the slave engine to change an initial throttle signal to the slave engine by an amount dependent on the servo signal to form a resultant throttle signal to the slave engine.

17. An apparatus as claimed in claim 16 in which:

(a) the force combining means includes an output shaft which is movable axially about a datum reflecting a balanced engine load condition, (b) the sensor elements are axially movable members adapted to cooperate with opposite end portions of the output shaft to move the shaft relative to the datum in response to forces from the sensor elements, (c) the comparison output means is responsive to signal input means cooperating with the output shaft to produce a movement relative to the datum to generate the differential signal.

18. An apparatus as claimed in claim 17 in which:

(a) the comparison output means has a main fluid valve having a valve body with a main bore, a power fluid input means to receive power fluid at a constant supply pressure, a power fluid exhaust means to vent power fluid, and a control fluid outlet means to discharge control fluid as required to reflect the differential signal, (b) the main bore has spaced input, exhaust and control ports to communicate with the power fluid input means, the exhaust means and the control fluid output means, and the signal input means is a signal input rod mounted within the main bore for relative movement therebetween to as to close or communicate respective ports as required to control output from the comparison output means.

19. An apparatus as claimed in claim 18 in which:

(a) the differential signal represents a degree of inequality between the power output of the master and slave engines, (b) the signal input rod has a main diameter compatible with the control bore, a compensation land having a diameter greater than the main diameter, a control land having a diameter equal to the main diameter, and a clearance portion having a diameter less than the main diameter and extending between the control land and an inner rod portion having a diameter equal to the main diameter and adjacent the compensation land, (c) the main bore has the control port positioned between the exhaust and input ports, and the input port is spaced from the control port by an amount approximately equal to length of the clearance portion, the main bore having first and second compensation ports which are spaced apart sufficiently to accept the compensation land therebetween, both of the compensation ports communicating with the control port.

20. A load sharing apparatus for sharing loads between coupled master and slave engines, the apparatus including:

(a) load comparison means having a comparison input means to receive load signals from each engine, and having a comparison output means to produce a differential signal reflecting comparison of the engine load signals, the differential signal being a pressurized control fluid signal, (b) servo means having a servo control input adapted to receive the differential signal from the comparison output means, and a servo output means producing a servo signal in response to the differential signal, the servo means also having a servo body having a servo fluid input means and partition means, the servo fluid input means receiving pressurized power fluid at a constant supply pressure, and the servo control input means receives the control fluid as required reflecting the differential signal from the comparison means, the partition means being movable relative to the servo body in response to difference between forces exerted thereon by the control fluid at a pressure reflecting the differential signal from the comparison means and by the power fluid at the essentially constant supply pressure, (c) coupling means to couple the servo output means to a throttle actuator of the slave engine to change an initial throttle signal to the slave engine by an amount dependent on the servo signal to form a resultant throttle signal to the slave engine.

21. An apparatus as claimed in claim 20 in which the servo means is further characterized by:

(a) the partition means being a piston slidable within the servo body, the piston defining first and second chambers disposed adjacent first and second faces respectively of the piston, the piston having a servo piston rod extending from the body to provide the servo output means, the first chamber receiving fluid from the comparison means representing the differential signed, and the second chamber receiving the power fluid at the essentially constant supply pressure, (b) fluid drain means to exhaust fluid passing the piston.

22. An apparatus as claimed in claim 21 further characterized by:

(a) the pressure of the differential signal reflecting a balanced engine load condition is termed equilibrium pressure and is at a particular ratio to the constant supply pressure, (b) the servo piston rod extends through the second chamber so that the second face of the piston has a smaller effective area than the first face, and a ratio of the areas of the first face to the second face is equal to the ratio of the supply pressure to the equilibrium pressure.

23. An apparatus as claimed in claim 16 further including:

(a) a negative feedback system cooperating with the load comparison means to combine a feedback signal reflecting the differential signal with the two engine load signals to produce the differential signal in such a manner that over-shoot and/or undershoot problems are reduced.

24. An apparatus as claimed in claim 20 further including:

(a) a negative feedback system cooperating with the load comparison means to combine a feedback signal reflecting the differential signal with the two engine load signals to produce the differential signal in such a manner that over-shoot and/or undershoot problems are reduced.

* * * * *